US005205726A

United States Patent [19]

Neward

[11] Patent Number: 5,205,726

[45] Date of Patent: Apr. 27, 1993

[54] TUBING REMOVER

[76] Inventor: Theodore C. Neward, 521 Scripps Dr., Claremont, Calif. 91711

[21] Appl. No.: 725,029

[22] Filed: Jul. 3, 1991

[51] Int. Cl.[5] ..... F04B 23/00; F04B 21/00

[52] U.S. Cl. ..... 417/572; 417/440

[58] Field of Search ..... 417/440, 572, 474, 475, 417/476, 477, 478, 479; 29/237, 235, 267

[56] References Cited

U.S. PATENT DOCUMENTS

| | | | |
|---|---|---|---|
| 3,061,915 | 11/1962 | Puryear | 29/235 |
| 3,612,722 | 10/1971 | Neward | 417/440 |
| 3,715,794 | 2/1973 | McCollum et al. | 29/235 |
| 4,806,084 | 2/1989 | Neward | 417/440 |

*Primary Examiner*—Richard A. Bertsch
*Assistant Examiner*—Alfred Basichas
*Attorney, Agent, or Firm*—Lyon & Lyon

[57] ABSTRACT

There is disclosed herein a small and compact vacuum pump which serves as a portable vacuum source. The pump basically includes a cylinder coupled with a handle, and a piston in the cylinder with another handle, along with a suitable valving assembly for allowing a vacuum to be drawn at an inlet of the pump. More particularly, there is also disclosed a tubing remover which can be attached to or form an integral part of the pump. The tubing remover comprises a lever and a fulcrum positioned in proximity to the vacuum port of the pump. One arm of the lever has an opening which is large enough to encircle the vacuum port, but smaller than the outside diameter of the tubing, such that the arm can be juxtaposed between the proximal end of the tubing and the pump. When the other arm of the lever is drawn towards the pump by a finger of the operator's hand, the arm proximating the tubing pushes the tubing away from the vacuum port. The above described motion of the lever is stabilized with the aid of a fork which embraces a portion of the pump.

18 Claims, 2 Drawing Sheets

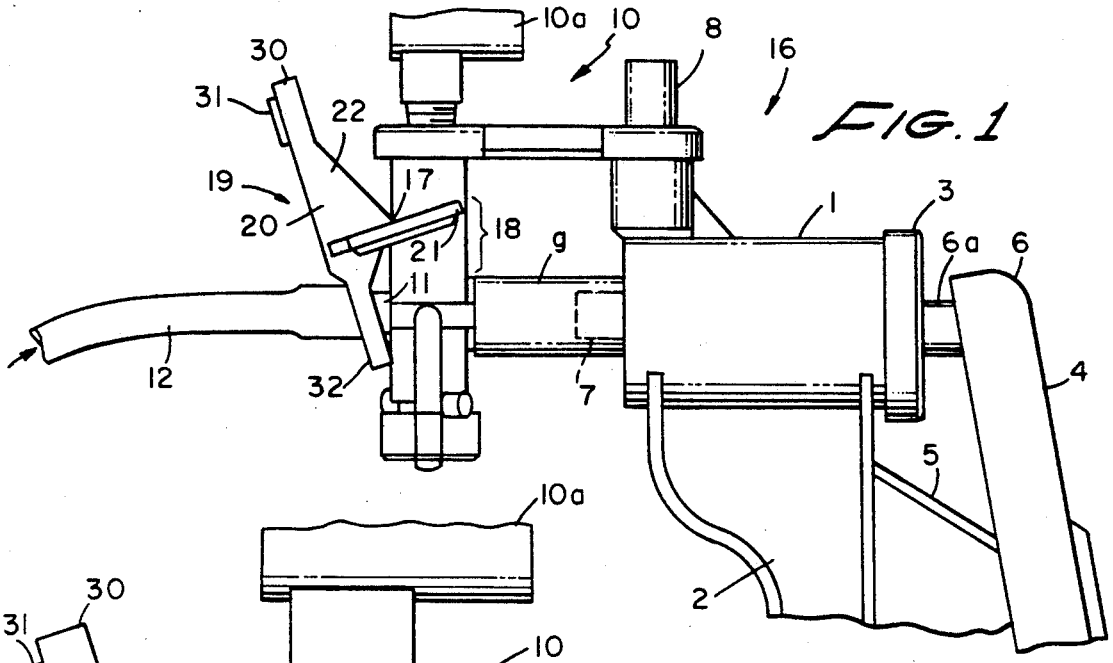
FIG. 1
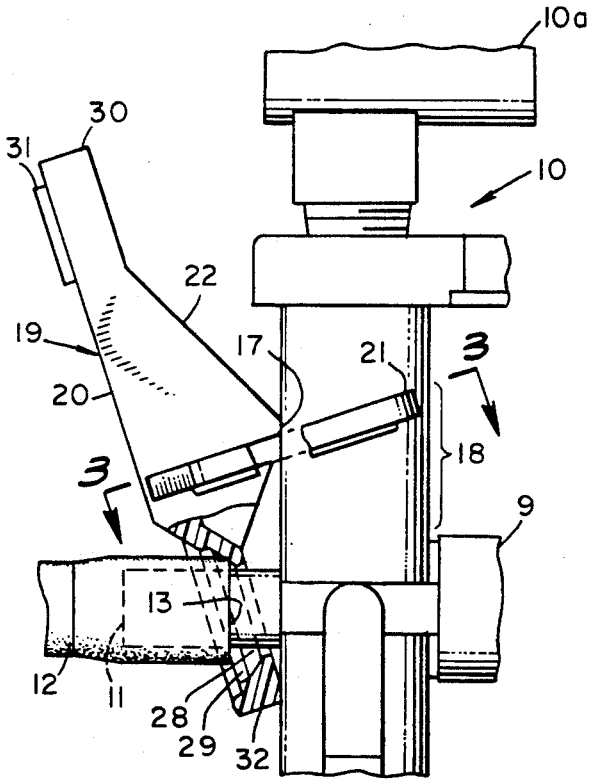
FIG. 2
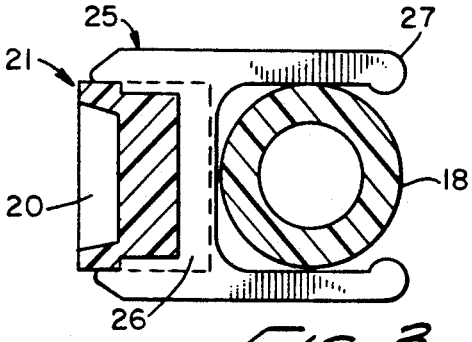
FIG. 3
FIG. 4
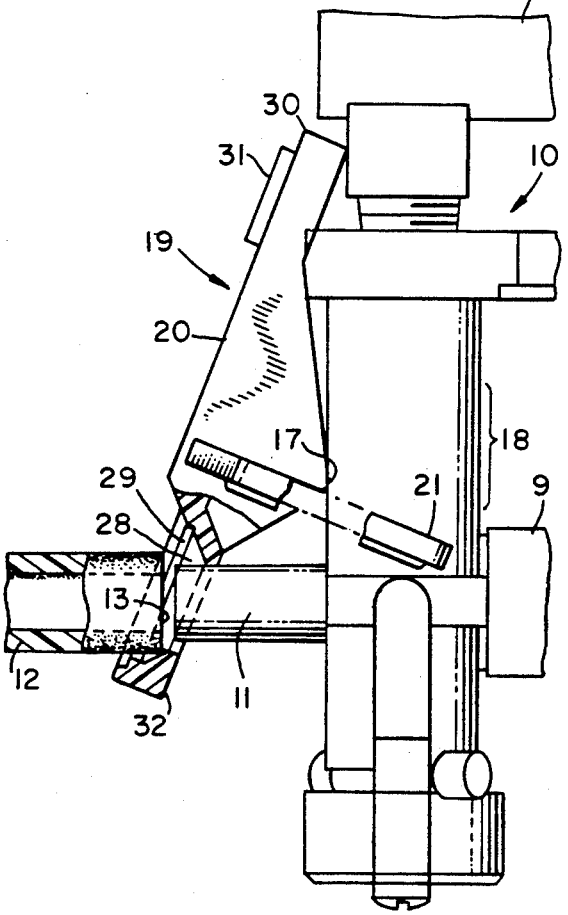

TUBING REMOVER

BACKGROUND OF THE INVENTION

The present invention relates to the field of hand-held vacuum pumps, particularly of the type disclosed in U.S. Pat. Nos. 3,612,722, 4,775,302 and 4,806,084 by the present inventor, the disclosures of which are incorporated herein by reference.

Vacuum pumps are generally useful whenever a vacuum is desired, for example, to provide suction. Many types of pumps have been devised, but they often suffer from such drawbacks as complexity, expense, excessive bulk, inability to pull a suitable vacuum, and the like. The vacuum pumps of the aforesaid patents have significantly solved the need for a vacuum pump which is simple, inexpensive, lightweight, compact and portable, and one which can pull a useful vacuum.

Such hand-held vacuum pumps are particularly useful in various industries, such as the automotive industry for vacuum testing and repair, liquid sampling and the like. In the medical field such pumps have been used, for example, with vacuum extraction devices in childbirth, an aid for testing for throat blocking of choking victims, and other uses. Vacuum pumps manufactured according to the aforesaid patents have the ability to pull a vacuum of, for example, twenty-eight inches of mercury.

In some applications for such vacuum pumps, tubing connects the vacuum pump to whatever device a vacuum is being applied. As one skilled in the use of such pumps will realize, it is sometimes difficult to readily disconnect the tubing from the vacuum pump. Furthermore, there are many hand held vacuum pumps in use which do not have a tubing remover, and which would realize greater useability with an after-market tubing remover.

SUMMARY OF THE INVENTION

The present invention provides an improvement on the aforesaid vacuum pumps by enabling the user to readily disconnect tubing from the vacuum pump.

The present invention comprises a hand-held vacuum pump having a vacuum port, a lever and a fulcrum positioned in proximity to the vacuum port. One arm of the lever has an opening which is large enough to encircle the vacuum port, but smaller than the outside diameter of the tubing, such that the arm can be juxtaposed between the proximal end of the tubing and the pump. When the other arm of the lever is drawn towards the pump by a finger of the operator's hand, the arm proximating the tubing pushes the tubing away from the vacuum port. The above described motion of the lever is stabilized with the aid of a fork which embraces a portion of the pump.

There are numerous benefits to the present invention. The use of reliable lever action results in a devise which is functional without unnecessary complexity or expense, and which is simple to install and operate. Since the tubing remover need not be permanently affixed to the pump, it can be used on a wide variety of new and existing pumps.

Accordingly, it is an object of the present invention to provide an improved hand-held vacuum pump.

Another object of this invention is to provide an improved tubing remover for a hand-held vacuum pump.

A further object of this invention is to provide a tubing remover which can be retrofitted to a hand-held vacuum pump.

BRIEF DESCRIPTION OF THE DRAWINGS

These and other objects of the present invention will become better understood through a consideration of the following description taken in conjunction with the drawings in which:

FIG. 1 is a partial side view showing a hand-held pump of the type shown and described in the aforesaid patents, a length of tubing, and an improved tubing remover according to the present invention coupled therewith.

FIG. 2 is a side view of the present invention in the cocked position.

FIG. 3 is a cross-sectional view taken along line 3—3 of FIG. 2 and which shows further detail of the fork.

FIG. 4 is a side view of the present invention in the released position.

DETAILED DESCRIPTION OF THE INVENTION

Figure 6:
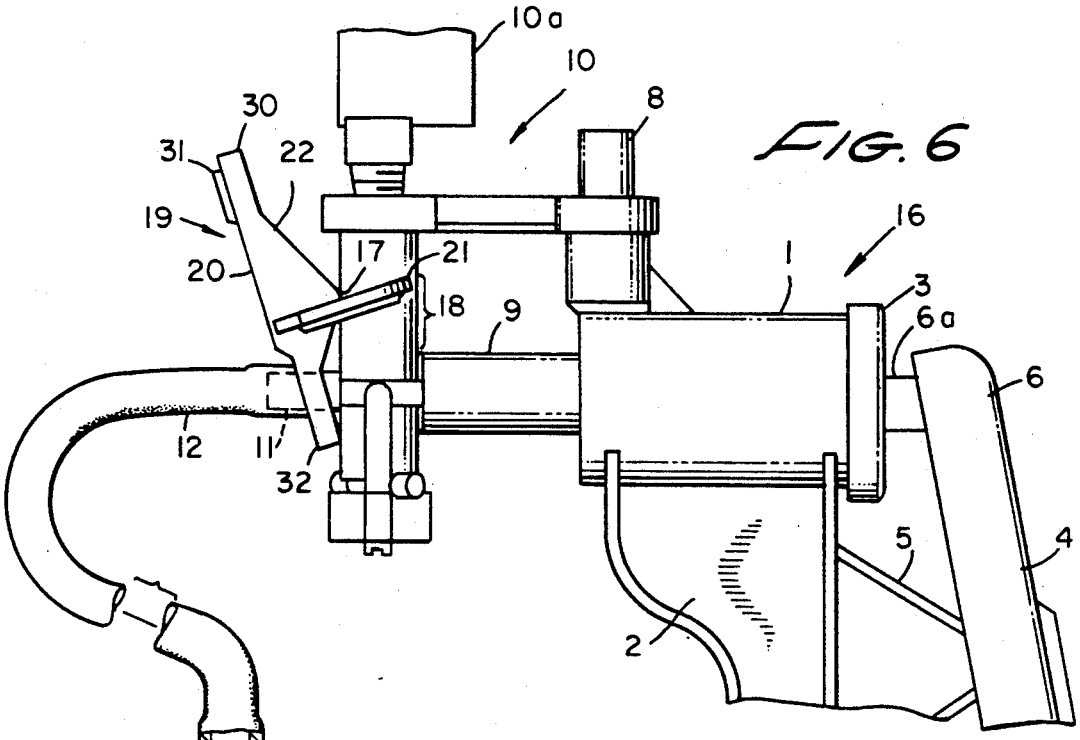
FIG. 6 is a side view showing a hand-held pump of the type shown and described in the aforesaid patents, a length of tubing running between the pump and an obstetrical vacuum extractor, and an improved tubing remover according to the present invention coupled therewith.

Turning now to the drawings, FIG. 1 depicts a vacuum pump of the type disclosed in the aforesaid patents, which pump includes a cylinder 1 connected to a first fixed handle 2. The cylinder 1 includes a cap 3 covering one end thereof, and a second movable handle 4 is pivoted on a support 5 attached to the handle 2. The handle 4 has its upper end connected at 6 via a piston rod 6*a* to a piston (not shown) within the cylinder 1. The cylinder 1 has an inlet port 7 and exhaust port 8 connected to the opposite end of the cylinder 1 from the cap 3, and includes an umbrella valve (not shown) and a duckbill valve (not shown) for allowing a vacuum to be drawn.

As will be apparent to those skilled in the art, squeezing the handles 2 and 4 together and releasing them causes the piston (not shown) to be reciprocated back and forth in the cylinder 1 as more fully described in U.S. Pat. No. 4,806,084 and the other patents, thereby causing a vacuum to be drawn at the inlet port 7. For purposes of this discussion, the vacuum pump 16 incorporates all the aforementioned elements plus one or more ancillary devices. By way of example, FIG. 1 depicts a "Tee" 10 connected to a vacuum gauge 10*a*. With this assembly in place, the pump 16 draws a vacuum through inlet port 7, the Tee 10, and vacuum port 11. It will be obvious to one skilled in the art that the exact position of the vacuum port will depend on what ancillary devices are incorporated into the vacuum pump 16. Where no ancillary device is incorporated into the vacuum pump 16, the inlet port 7 serves as the vacuum port 11.

Also in FIG. 1, a length of tubing 12 is removably attached to the vacuum port 11. The tubing 12 has a proximal end 13 shown in FIG. 2 and a distal end 14 depicted in FIG. 6. The distal end 14 is removably attached to whatever device a vacuum is being applied. By way of example, the device to which a vacuum is being applied in FIG. 6 is an obstetrical vacuum extractor 15.

FIG. 1 further depicts a tubing remover 19 having a lever 20 and a fork 21 operationally positioned on the vacuum pump 16. The lever 20 has a trigger arm 30 with a finger pad 31, an actuating arm 32, and a wedge shaped extension 22 which juxtaposes a fulcrum portion 17 against the vacuum pump 16.

Figure 5:
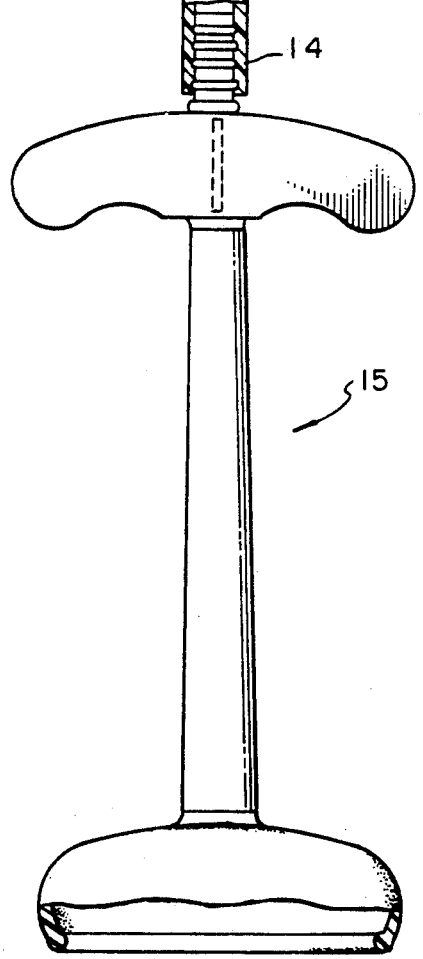
FIG. 5 is an exploded view of the lever and fork.
Figure 5:
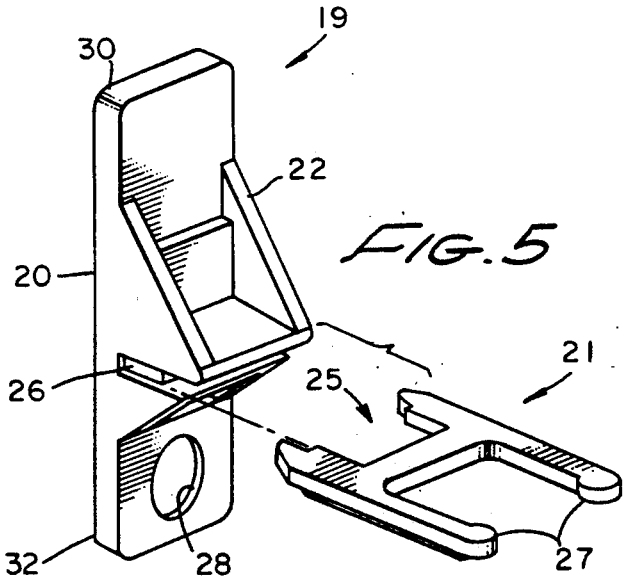
Figure 5A:
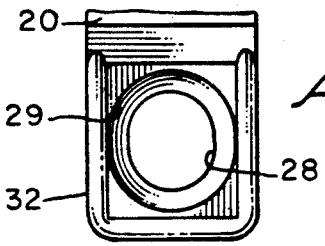
FIG. 5*a* is a frontal view of the actuating arm showing the aperture and depression.

In FIGS. 2, 4, and 5*a*, the actuating arm 32 of the lever 20 is further shown to have a depression 29 surrounding the opening 28. It will be apparent to one skilled in the art that the opening 28 need not be fully enclosed, and that a yoke will suffice. An enclosed opening is merely the presently preferred means of carrying out the invention. Both the opening 28 and the depression 29 are depicted in the drawing as elliptically shaped, which shape will be further discussed below. As is shown in FIGS. 1, 2, 4 and 6, the vacuum port 11 extends through the opening 28, with the depression 29 juxtaposing the proximal end 13 of the tubing 12.

Also in FIG. 5, the fork 21 has a base 25 which is sized and dimensioned to fit into a slot 26 on the lever 20 in a tongue-and-groove manner. On the end of the fork 21 opposite the base 25 are two tines 27. As shown in FIGS. 1, 2, 3, 4, and 6, the tines 27 embrace a shaft portion 18 of the vacuum pump 16. The combination of the vacuum port 11 extending through the opening 28, and the tines 27 embracing the shaft portion 18 of the pump 16, limits the range of motion of the lever 20 with respect to the pump 16.

When no tubing is attached to the vacuum port 11, the lever 20 is free to rock back and forth upon the wedge-shaped extension 22. However, when tubing 12 is attached to the vacuum port 11, the lever 20 is pushed into a cocked position as depicted in FIG. 2. When the user desires to remove the tubing 12, the index finger is wrapped around the trigger arm 30 of the lever 20 and pulled against the finger pad 31, thereby drawing the trigger arm 30 towards the pump 16. The pulling action forces the actuating arm 32 of the lever 20 to pres against the proximal end 13 of the tubing 12 and pushes the tubing 12 away from the vacuum port 11. In actual practice, the tubing 12 is "peeled" away from the port 11. The end result of the pulling action places the lever 20 into a released position as depicted in FIG. 4.

The utility of the elliptical shape of the opening 28 can now be fully appreciated. It should be apparent to one skilled in the art that the lever 20 must move between positions out of perpendicular with respect to the vacuum port 11. Since a circular opening having the same diameter as a perpendicular cross-section of the vacuum port 11 would prevent the lever 20 from titling out of perpendicular with respect to the vacuum port 11, the opening 28 must either be non-circular or must be circular having a diameter significantly greater than the perpendicular cross-sectional area of the port 11. While a circular opening having a relatively large diameter would ineffectively engage the proximal end 13 of the tubing 12, an elliptical opening maximally engages the proximal end of the tubing.

The lever 20 can be manufactured from several suitably rigid materials, including without limitation metals such as steel and plastics such as polyvinyl chloride and nylon. In the preferred embodiment, the lever 20 is manufactured from nylon.

While embodiments of the present invention have been shown and described, various modifications may be made without departing from the scope of the present invention, and all such modifications and equivalents are intended to be covered.

What is claimed is:

1. A hand-held vacuum pump, comprising a cylinder for isolating a volume from the atmosphere and having an inlet port and an outlet port, biased piston means for drawing a vacuum through the inlet port of the cylinder and including a piston which can be moved in the cylinder, handle means coupled with the cylinder means and the piston means, and a tubing remover having a lever with at least two arms, one arm of the lever having an opening sized and dimensioned to at least partially encircle the inlet port and to allow the lever to rock while an engagement between the one arm of the lever and a tubing end on the inlet port is maintained, the opening juxtaposed between the tubing end and the vacuum pump, a rocker means for establishing a fulcrum between the lever and the vacuum pump, which rocker means enables the lever to reciprocate back and forth in a rocking motion, and means for stabilizing the rocking motion of the lever.

2. The pump as in claim 1 wherein the lever, rocker and means for stabilizing are formed from polyvinyl chloride.

3. In combination with a vacuum pump having a vacuum port and tubing having at least one end sized and dimensioned to mate with the vacuum port, a tubing remover for engaging the tubing end and facilitating removal of the tubing from the pump comprising:

a lever having at least two arms, one arm of the lever having an opening sized and dimensioned to at least partially encircle the vacuum port and to allow the lever to rock while engagement between the one arm of the lever and the tubing end is maintained, the opening being juxtaposed between the tubing end and the vacuum pump, a rocker means for establishing a fulcrum between the lever and the vacuum pump, which rocker means enables the lever to reciprocate back and forth in a rocking motion, means for stabilizing the rocking motion of the lever, and the second arm of the lever sized and dimensioned to allow finger control of the rocking motion.

4. The tubing remover as in claim 2 wherein the lever, rocker and means for stabilizing are formed from polyvinyl chloride.

5. A tubing remover for use in removing a tubing end from a vacuum port of a vacuum pump comprising:

a lever having at least two arms, one arm of the lever having an opening sized and dimensioned to at least partially encircle the vacuum port and to allow the lever to rock while an engagement between the one arm and the tubing end on the vacuum port is maintained, the opening being juxtaposed between the tubing end and the vacuum pump, a rocker means for establishing a fulcrum between the lever and the vacuum pump, which rocker means enables the lever to reciprocate back and forth in a rocking motion, means for stabilizing the rocking motion of the lever, and the second arm of the lever sized and dimensioned to allow finger control of the rocking motion.

6. The tubing remover as in claim 5 wherein the lever, rocker and means for stabilizing are formed from the group of materials; polyvinyl chloride, nylon.

7. A hand-held vacuum pump, comprising a cylinder for isolating a volume from the atmosphere and having an inlet port and an outlet port, biased piston means for drawing a vacuum through the inlet port of the cylinder and including a piston which can be moved in the cylinder, handle means coupled with the cylinder means and the piston means, and a tubing remover having a lever with at least two arms, one arm of the lever having an opening comprising a substantially elliptical aperture, having long and short axes, the long axis falling within a plane defined by a rocking motion of the lever, the opening sized and dimensioned to encircle the vacuum port, the opening juxtaposed between a tubing end on the vacuum port and the vacuum pump, a rocker means for establishing a fulcrum between the lever and the vacuum pump, which rocker means enables the lever to reciprocate back and forth in a rocking motion, and means for stabilizing the rocking motion of the lever.

8. The pump as in claim 7 wherein the opening further comprises a substantially elliptical depression circumjacently disposed about the aperture and facing towards the tubing, the depression sized and dimensioned to accommodate the external diameter of the tubing end.

9. A hand-held vacuum pump, comprising a cylinder for isolating a volume from the atmosphere and having an inlet port and an outlet port, biased piston means for drawing a vacuum through the inlet port of the cylinder and including a piston which can be moved in the cylinder, handle means coupled with the cylinder means and the piston means, and a tubing remover having a lever with at least two arms, one arm of the lever having an opening sized and dimensioned to at least partially encircle the vacuum port, the opening juxtaposed between a tubing end on the vacuum port and the vacuum pump, a rocker means for establishing a fulcrum between the lever and the vacuum pump, which rocker means enables the lever to reciprocate back and forth in a rocking motion, the rocker means comprising a substantially wedge-shaped extension from the lever, and means for stabilizing the rocking motion of the lever.

10. A hand-held vacuum pump, comprising a cylinder for isolating a volume from the atmosphere and having an inlet port and an outlet port, biased piston means for drawing a vacuum through the inlet port of the cylinder and including a piston which can be moved in the cylinder, handle means coupled with the cylinder means and the piston means, and a tubing remover having a lever with at least two arms, one arm of the lever having an opening sized and dimensioned to at least partially encircle the vacuum port, the opening juxtaposed between a tubing end on the vacuum port and the vacuum pump, a rocker means for establishing a fulcrum between the lever and the vacuum pump, which rocker means enables the lever to reciprocate back and forth in a rocking motion, and means for stabilizing the rocking motion of the lever, said stabilizing means comprising a fork having a handle and at least two tines, the handle removably affixed to the lever, and the tines at least partially encircling a portion of the body.

11. In combination with a vacuum pump having a vacuum port and tubing having at least one end sized and dimensioned to mate with the vacuum port, a tubing remover for engaging the tubing end and facilitating removal of the tubing from the pump comprising:

a lever having at least two arms, one arm of the lever having an opening comprising a substantially elliptical aperture having long and short axes, the long axis falling within a plane defined by a rocking motion of the lever, the opening being sized and dimensioned to encircle the vacuum port, the opening being juxtaposed between the tubing end and the vacuum pump, a rocker means for establishing a fulcrum between the lever and the vacuum pump, which rocker means enables the lever to reciprocate back and forth in a rocking motion, means for stabilizing the rocking motion of the lever; and the second arm of the lever sized and dimensioned to allow finger control of the rocking motion.

12. The tubing remover as in claim 11 wherein the opening further comprises a substantially elliptical depression circumjacently disposed about the aperture and facing towards the tubing, the depression sized and dimensioned to accommodate the external diameter of the tubing end.

13. In combination with a vacuum pump having a vacuum port and tubing having at least one end sized and dimensioned to mate with the vacuum port, a tubing remover for engaging the tubing end and facilitating removal of the tubing from the pump comprising:

a lever having at least two arms, one arm of the lever having an opening sized and dimensioned to at least partially encircle the vacuum port, the opening being juxtaposed between the tubing end and the vacuum pump, a rocker means for establishing a fulcrum between the lever and the vacuum pump, which rocker means enables the lever to reciprocate back and forth in a rocking motion, the rocker means comprising a substantially wedge-shaped extension from the lever, means for stabilizing the rocking motion of the lever, and the second arm of the lever sized and dimensioned to allow finger control of the rocking motion.

14. In combination with a vacuum pump having a vacuum port and tubing having at least one end sized and dimensioned to mate with the vacuum port, a tubing remover for engaging the tubing end and facilitating removal of the tubing from the pump comprising:

a lever having at least two arms, one arm of the lever having an opening sized and dimensioned to at least partially encircle the vacuum port, the opening being juxtaposed between the tubing end and the vacuum pump, a rocker means for establishing a fulcrum between the lever and the vacuum pump, which rocker means enables the lever to reciprocate back and forth in a rocking motion, means for stabilizing the rocking motion of the lever, said stabilizing means comprising a fork having a handle and at least two tines, the handle removably fixed to the lever, and the tines at least partially encircling a portion of the body, and the second arm of the lever sized and dimensioned to allow finger control of the rocking motion.

15. A tubing remover for use in removing tubing from a vacuum port of a vacuum pump comprising:

a lever having at least two arms, one arm of the lever having an opening comprising a substantially elliptical aperture having long and short axes, the long axes falling within a plane defined by a rocking motion of the lever, the aperture sized and dimensioned to encircle the vacuum port, the opening being juxtaposed between a tubing end and the vacuum pump, a rocker means for establishing a fulcrum between the lever and the vacuum pump, which rocker means enables the lever to reciprocate back and forth in a rocking motion, means for stabilizing the rocking motion of the lever, and the second arm of the lever sized and dimensioned to allow finger control of the rocking motion.

16. The tubing remover as in claim 15 wherein the opening further comprises a substantially elliptical depression circumjacently disposed about the aperture and facing towards the tubing, the depression sized and dimensioned to accommodate the external diameter of the tubing end.

17. A tubing remover for use in removing tubing from a vacuum port of a vacuum pump comprising:

a lever having at least two arms, one arm of the lever having an opening sized and dimensioned to at least partially encircle the vacuum port, the opening being juxtaposed between a tubing end and the vacuum pump, a rocker means for establishing a fulcrum between the lever and the vacuum pump, which rocker means enables the lever to reciprocate back and forth in a rocking motion, the rocker means comprising a substantially wedge-shaped extension from the lever, means for stabilizing the rocking motion of the lever, and the second arm of the lever sized and dimensioned to allow finger control of the rocking motion.

18. A tubing remover for use in removing tubing from a vacuum port of a vacuum pump comprising:

a lever having at least two arms, one arm of the lever having an opening sized and dimensioned to at least partially encircle the vacuum port, the opening being juxtaposed between a tubing end and the vacuum pump, a rocker means for establishing a fulcrum between the lever and the vacuum pump, which rocker means enables the lever to reciprocate back and forth in a rocking motion, means for stabilizing the rocking motion of the lever, said stabilizing means comprising a fork having a handle and at least two tines, the handle removably affixed to the lever, and the tines at least partially encircling a portion of the body, and the second arm of the lever sized and dimensioned to allow finger control of the rocking motion.

* * * * *

UNITED STATES PATENT AND TRADEMARK OFFICE

CERTIFICATE OF CORRECTION

PATENT NO. : 5,205,726

DATED : April 27, 1993

INVENTOR(S) : Theodore C. Neward

It is certified that error appears in the above-identified patent and that said Letters Patent is hereby corrected as shown below:

Column 3, line 40, "pres" should be

-- press --

Column 3, line 53, "titling" should be

-- tilting --

Column 7, line 1, "fixed" should be

-- affixed --

Signed and Sealed this

Eighteenth Day of January, 1994

*Attest:*

Bruce Lehman

BRUCE LEHMAN

*Attesting Officer*

*Commissioner of Patents and Trademarks*